United States Patent [19]

Thomas et al.

[11] 4,131,422

[45] Dec. 26, 1978

[54] POLYMER-PRINTED FABRIC AND METHOD FOR PRODUCING SAME

[75] Inventors: Manuel A. Thomas; Jerry A. Cogan, Jr., both of Spartanburg, S.C.

[73] Assignee: Milliken Research Corporation, Spartanburg, S.C.

[21] Appl. No.: 770,877

[22] Filed: Feb. 22, 1977

[51] Int. Cl.[2] ..... C09B 65/00; D06P 1/36

[52] U.S. Cl. ..... 8/31; 8/14; 8/15; 8/25; 8/72; 8/100 R

[58] Field of Search ..... 8/31, 72, 100, DIG. 18, 8/14, 15, 70, 100 R

[56] References Cited

U.S. PATENT DOCUMENTS

| | | | |
|---|---|---|---|
| 1,837,686 | 12/1931 | Spencer | 8/66 |
| 2,328,900 | 9/1943 | Grimm et al. | 8/31 |
| 2,376,891 | 5/1945 | Alles | 8/31 |
| 2,681,867 | 6/1954 | Miller | 8/72 |
| 3,083,118 | 3/1963 | Bridgeford | 117/47 |
| 3,227,510 | 1/1966 | Bridgeford | 8/14 |
| 3,359,059 | 12/1967 | Gagliardi | 8/72 |
| 3,622,264 | 11/1971 | Brown et al. | 8/31 |
| 3,652,198 | 3/1972 | Farber et al. | 8/31 |
| 3,743,477 | 7/1973 | Egli et al. | 8/66 |
| 3,795,480 | 3/1974 | Harper et al. | 8/18 |
| 3,807,946 | 4/1974 | Harper et al. | 8/18 |
| 3,989,453 | 11/1976 | Jilla | 8/66 |
| 4,050,892 | 9/1977 | Jilla | 8/4 |
| 4,087,243 | 5/1977 | Thomas et al. | 8/31 |

FOREIGN PATENT DOCUMENTS

| | | |
|---|---|---|
| 551693 | 3/1943 | United Kingdom. |
| 1337702 | 11/1973 | United Kingdom. |

OTHER PUBLICATIONS

Saunders and Frisch, "Polyurethanes Chemistry and Technology", (Interscience, 1964), p. 748.

*Primary Examiner*—A. Lionel Clingman
*Attorney, Agent, or Firm*—Glen M. Burdick; H. William Petry

[57] ABSTRACT

Polymer-printed fabrics are produced by applying to a textile fabric substrate, in a pre-determined pattern, an aqueous admixture consisting essentially of from about 1 and to about 45 percent of a substantially water-soluble acid dyeable polymer having a cationic charge in milliequivalents/gram of polymer of from about 0.01 to about 5. The aqueous admixture is further characterized as having a viscosity of from about 5 to about 50,000 centipoise. The wetted printed substrate is dried to remove substantially all the water and thereafter cured. The cured polymer printed substrate is then dyed with a dye admixture containing an acid dyestuff preferential to the polymer coated portion of the substrate.

18 Claims, No Drawings

POLYMER-PRINTED FABRIC AND METHOD FOR PRODUCING SAME

This invention relates to a novel polymer-printed fabric and more particularly relates to a new polymer-printed fabric having differential dyeing characteristics. In one aspect it relates to an improved method for producing polymer-printed fabrics having differential dyeing characteristics.

Conventionally, multi-colored or multi-shade fabrics have been produced by knitting or weaving yarn which had been dyed different colors. However, the use of dyed yarns is considerably less desirable because of the extra cost involved in yarn dyeing and the limitations that the colors must be selected prior to the formation of the fabric.

Also, it has been proposed to use yarns with different dyeing characteristics. For example, a mixture of polyamide and polyester yarns may provide a differential color effect with certain dyes. However, this method is limited in the same way as the yarn-dyed fabrics in that the pattern must be introduced during the knitting or weaving operation.

British Pat. No. 1,337,702 discloses a process for providing fabrics with the capability of being dyed in multi-colored effects by applying to pre-determined places on a textile a colorless preparation containing an organic solution or an aqueous dispersion of an acrylic acid ethyl ether capable of being crosslinked and a cross-linking substance based on melamine-formaldehyde. While the process of the patent produces multi-color effect, the use of such resins and cross-linking agents have required the use of cationic or basic dyes. Such cationic dyes are less light stable, less durable and more expensive than the normal acid dyes. Thus, products using cationic or basic dyes often suffer from the disadvantages of not being stable to light, not washable in normal laundry procedures, and are expensive to manufacture.

According to the present invention novel fabrics are provided which possess a pleasantly soft hand and which can be dyed to produce multi-color or multi-shade fabrics. Further according to the invention an improved method for producing polymer-filled fabrics having differential dyeing characteristics is provided which comprises applying to a textile substrate, in a pre-determined pattern, an aqueous admixture containing from about 1 to about 45 percent of a substantially water-soluble acid dyeable polymer having a cationic charge in milliequivalents/gram of polymer of from about 0.01 to about 5. The textile fabric substrate printed with the aqueous admixture is thereafter dried at a temperature effective to remove substantially all of the water. The dried substrate is subjected to elevated temperatures for a period of time effective to cure the polymer and to insure crosslinking of the polymer with the textile substrate. The cured polymer printed substrate is thereafter contacted with a dye admixture containing an acid dye stuff preferential to the polymer coated portion of the substrate.

The fabric to which the aqueous admixture is applied as a predetermined pattern can be a woven or knitted fabric. The fabric may be constructed of natural, synthetic or polymer fibers such as cotton, rayon, polyester, polyamide, polyacrylic and the like. Preferred fabrics are constructed from polyester fibers and blends of such fibers either in the individual yarns or in combinations of different yarns. The yarns employed to produce the textile fabric substrate may also be continuous filaments or spun yarns.

After selection of the desired makeup of the textile fabric substrate the polymer constituents can be applied thereto, in a predetermined pattern, by any suitable means well known in the art, such as by the use of engraved rolls or printing screen techniques. Any other suitable means of applying the liquid admixture containing the polymeric constituents to the textile fabric substrate can be employed. However, especially desirable results have been obtained when the aqueous admixture containing the acid dyeable polymeric component is applied to the textile substrate by the use of a rotary screen printing technique.

The polymer-printed fabric of the present invention having differential dyeing characteristics are produced by applying to the textile substrate, in a pre-determined pattern, an aqueous admixture consisting essentially of from about 1 to about 45 weight percent, based upon the weight of the admixture, of a substantially water-soluble acid dyeable polymer. The term "acid dyeable polymer" as used herein is to be understood to mean any film forming polymer containing cationic sites attached to the polymer as terminating or internal groups. However, the degree and availability of the cationic sites must be of such a degree that the anionic dyes, e.g. acid dyes, are "sorbed" by an ion-exchange mechanism. In order to meet the above criteria the acid dyeable polymers applied to the textile substrate must have a basisity (cationic charge) in milliequivalents/gram of polymer of from about 0.01 to about 5, preferably from about 0.1 to about 1, such being sufficient to give a color reading of from about 10 to about 100 (percent absorption at a wavelength of 630 nm) after dyeing when compared to an undyed control fabric as measured on a spectrophotometer. Thus, any suitable acid dyeable water-soluble polymer having the necessary cationic sites and which is capable of forming a film can be employed in the method of the present invention. However, especially desirable results can be obtained when the polymeric backbone of the acid dyeable polymers is polyurethane, polyacrylate, polyvinyl pyridine, a thermosetting polymer (aminoplast) or a polymer formed as the reaction product of a polyamide and a polyepoxide having at least two 1,2-epoxy groups per molecule.

To further illustrate such acid dyeable polymers, e.g. cationic charged polymers, which can be employed in the practice of the present invention the following structural examples are given. In each example the bracketed portion represents the portion of the polymeric backbone.

polyurethane

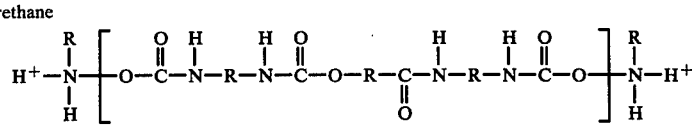

wherein each R is an alkyl, alkene, or cycloalkyl group, such as

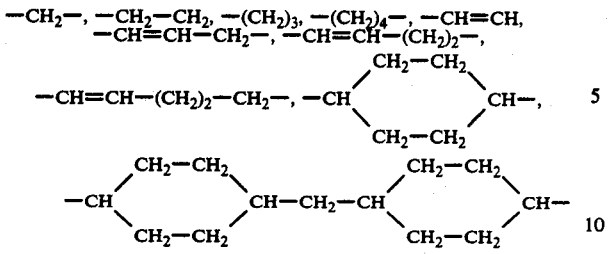

and the like.

polyvinyl pyridine

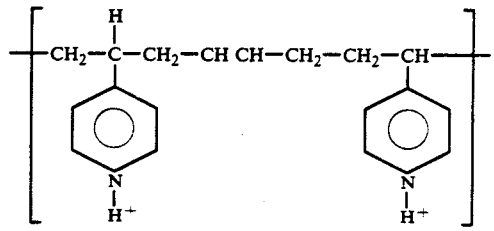

thermosetting polymer — any suitable thermosetting polymer having the required cationic group and meeting the criteria set forth herein before, such as:

melamine—formaldehyde condensation product

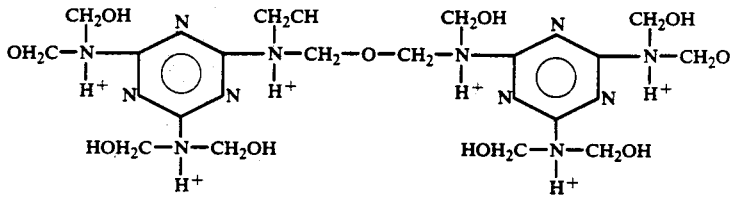

polyacrylate

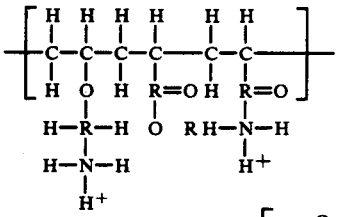

Reaction product of a polyamide and a polyepoxide having at least two 1,2-epoxy groups per molecule.

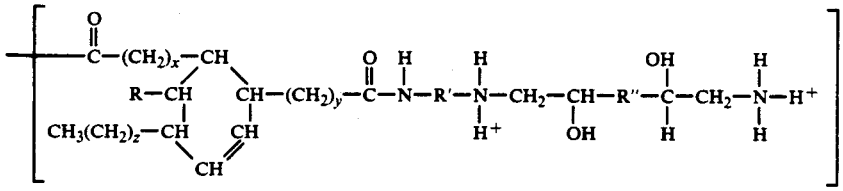

wherein R is as previously defined, x, y and z are integers of from 0 to about 12, R′ is $(CH_2)$, $(CH_2)_2$, $(CH_2)_2NH(CH_2)_2$, $(CH_2)_2$—NH—$(CH_2)_2NH$—$(CH_2)_2$ and the like, and R″ is a saturated or unsaturated aliphatic, cycloaliphatic, aromatic or heterocyclic group. Typical of such groups are $-CH_2-(CH_2)_2CH_2-$, $-CH_2-(CH_2)_4CH_2-$, $-CH_2-O-(CH_2)_4OCH_2$,

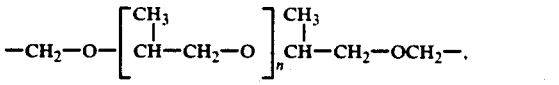

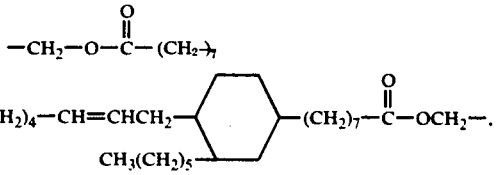

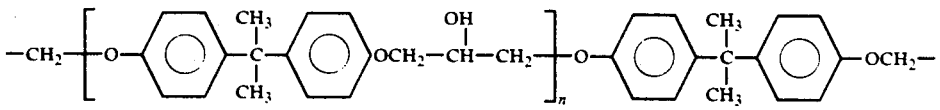

and the like. n is an integer of from 0 to about 10.

The viscosity of the aqueous admixture containing the desired amount of the water-soluble acid dyeable polymer which can be applied to the textile fabric substrate in accordance with the present invention can vary widely. However, it is generally desirable that the viscosity of the liquid admixture be maintained in the range of from about 5 to about 50,000 centipoise (Brookfield wherein each R is as defined above.

#4 Spindle/12 r.p.m.). Especially desirable results can be obtained when the aqueous admixture has a viscosity of from about 20 to about 40,000 centipoise.

As previously stated, the essential ingredient of the aqueous admixture employed to produce the polymer-printed fabircs with differential dyeing characteristics of the present invention is the substantially water-soluble acid dyeable polymer. However, in addition to the acid dyeable polymer additional components, such as thickening agents, hygroscopic agents, anti-foaming agents, catalysts, volatile stabilizing agents and water fugitive tints can be incorporated in minor effective amounts in the liquid admixture. The amount of each of the additional components incorporated into the aqueous admixture can vary widely and will be dependent to a large extent upon the properties sought in the resulting liquid admixture. For example, in order to maintain the liquid admixture in a preselected viscosity range of from about 5 to 50,000 centipoise it is often necessary to incorporate into the aqueous admixture, in addition to the substantially water-soluble acid dyeable polymeric constituent, an effective amount of a thickening agent. The amount of thickening agent employed can vary widely depending upon the amount of polymeric constituent employed as well as the type of such constituent. However, it has been found generally desirable to incorporate from about 0.5 to about 3 weight percent of a thickening agent into the aqueous admixture to provide an aqueous admixture having the desired viscosity. Any suitable thickening agent can be employed provided it is compatable with the polymer, the textile substrate, and the acid dye stuff employed to dye the polymeric constituent. Typical of such thickeners are polyacrylic acids, hydroxy ethyl cellulose, natural gums, and the like.

In addition to the use of thickening agents, it is often desirable to incorporate an effective amount of a hygroscopic agent into the aqueous admixture. Such is especially beneficial when employing a polyurethane polymer as the substantially water-soluble acid dyeable polymer. However, even when employing other polymer constituents desirable results are obtained by incorporating into the aqueous admixture the hygroscopic agent. Generally, it has been found advantageous, when employing the hygroscopic agent, to incorporate such into the admixture in an amount of from about 3 to about 5 weight percent. Typical hygroscopic agents which can be employed in producing the improved polymer-printed fabrics of the present invention are ethylene glycol, glycerine, polyethylene glycols, propylene glycols and the like.

In addition to the thickening agents and the hygroscopic agent it is often desirable to retard and/or substantially eliminate any foaming of the aqueous admixture which might occur due to application of the aqueous admixture to a textile fabric substrate. Such is often desirable in order to allow one to provide a more distinct pattern. Any suitable anti-foaming agent can be employed and the amount of such anti-foaming agent can vary widely. However, it is generally desirable that the anti-foaming agent be employed in an amount of from about 0.1 to about 0.3 weight percent. Typical anti-foaming agents which can be employed in producing the polymer-printed fabrics having improved differential dyeing characteristics are polydimethyl siloxanes, triethanolamines, 2-ethyl hexanol, long chain alcohols, polyols, and the like.

The liquid admixture applied to the textile fabric substrate, and the resulting polymeric design imprinted on the fabric substrate is substantially colorless. It is often desirable to incorporate into the aqueous admixture, and thus the polymer constituent, an effective minor amount, generally from about 0.1 to about 2 weight percent, of a fugitive tint. The fugitive tint allows one to detect and determine the presence of the polymeric constituent on the substrate after the application of the aqueous mixture. The particular fugitive tint employed should be not only water-soluble but should be readily removable by an aqueous scour after drying and curing of the polymeric constituent so as to not interfer in any way with the dyeing procedures or result in a discolored product. However, care must be exercised in the selection of the fugitive tint to insure that the tint composition in no way reacts with the polymeric constituent. Typical of such water-soluble fugitive tints which can be employed in accordance with the present invention are the commercially available fugitive tints sold under the designation "Easy-Rid" Fugitive Tints, and having color designation such as KPD 2 Green, KPD 4 Orange, KPD 11 Parrot Green, and the like.

When employing a thermosetting polymer, such as a melamineformaldehyde polymer, as the polymeric constituents in the aqueous admixture it is often desirable to incorporate a catalytic amount of a latent acid catalyst. The term "latent acid catalyst" as used herein is to be understood to mean a compound which upon application of heat liberates acid groups to aid in the cross-linking of the polymeric constituent. Typical of such latent acid catalyst are diamonium phosphate ammonium chloride, zinc nitrate, and the like. In addition to the use of a latent acid catalyst, when employing a thermosetting resin as the water-soluble polymeric constituent of the aqueous admixture, it is often desirable to incorporate into the aqueous admixture from about 0.5 to about 3 weight percent of a volitale stabilizing agent, such as ammonium hydroxide, and an effective amount of an abrasive resistant agent so as to improve the crockfastness and durability of the resulting product.

The amount of the abrasive resistant agent employed can vary widely but will generally be in an amount of from about 0.5 to about 10 weight percent, preferably from about 1.5 to about 3.5 weight percent. Any suitable abrasive resistant agent can be employed provided it does not deleteriously react with the polymeric constituent. Typical of abrasive resistant agents which can be employed in the method of the present invention and to produce the improved polymer-printed fabrics are the acrylic polymers, ethylenevinylacetate polymers, alkyd polymers, vinlidene chloride, polybutadiene, urethane, and the like.

After application of the aqueous mixture containing the substantially water-soluble acid dyeable polymer to the textile fabric substrate in the desired pattern, the polymer printed substrate is dried at a temperature effective to remove substantially all of the water from the substrate and from the polymeric constituent. Thereafter, the substantially dried polymer printed substrate is subjected to elevated temperatures for an effective period of time to substantially cure the polymeric constituent on the substrate and thus insure crosslinking of the polymer. The temperature at which the polymer is cured can vary widely but will generally be at a temperature in the range of from about 275° F. to about 300° F. The curing step not only suffices in the desired crosslinking of the polymer but also fixes the polymer securely to the textile fabric substrate.

The cured polymer printed substrate can then be subjected to other processing steps, such as washing and drying to effectively remove any unreacted polymer constituents and to remove any fugitive tints which may be present in the polymer.

The cured, polymer coated textile fabric substrate is then dyed with a dye admixture containing acid dye stuffs using procedures well known by those skilled in the art. The cured polymer constituent on the textile fabric substrate receives and takes up the acid dyestuffs whereas the untreated portions of the fabric are substantially resistant to the acid dye stuffs. Thus, after dyeing the dyed pattern on the textile fabric substrate is a result of the dye uptake of the cured polymeric pattern. After dyeing, the dyed textile material can be further treated to improve the appearance, hand, crockfastness and the like of the dyed material. The desirability of the further treatment of the dyed textile material will be determined largely by the end use for which the dyed textile material is to be employed. If desirable, minor effective amounts of soil release agents, water-proofing agents, mildewcides, softeners and the like can be applied to the surface of the dyed textile material by any suitable means, such being well known in the art.

If desired, the dye bath can contain, in addition to the acid dyestuffs, a dyestuff which is preferential to the untreated or unmodified portion of the textile fabric material. In such instances the acid dyestuff will preferentially dye that portion of the fabric substrate containing the polymeric constituent and the unmodified portion will be preferentially dyed by the other dyestuff to produce a multi-colored or tone-on-tone fabric. The dyes normally employed for the dyeing of the untreated portion of the polymer-printed fabric of the invention are dispersed and cationic dyes, and such dyes are well known in the art.

In order to further illustrate the present invention the following examples are given. Such examples are given for the purpose of illustration and are not to be construed as unduly limiting the scope of the present invention as set forth in the claims hereafter. In each of the examples all parts are parts by weight unless otherwise specified.

EXAMPLE I

A Raschel fabric made from 94% T242 disperse dyeable polyester and 6% Nylon was rotary screen printed with the following melamine formaldehyde polymer formulation:

| | As rec'd. o.w. Mix % |
|---|---|
| Water | 74.3 |
| Diammonium Phosphate (catalyst) | 2.0 |
| Fugitive Tint | 2.0 |
| Antifoaming Agent | 0.2 |
| Ammonium Hydroxide (Stabilizer) | 1.4 |

-continued

| | As rec'd. o.w. Mix % |
|---|---|
| Aerotex MW (Melamine Formaldehyde) | 9.5 |
| Binder (Acrylic Polymer- Rhoplex HA 16) | 4.1 |
| Thickner (Aqua Hue Conc. 2177) | 6.5 |
| | 100.0 |

The melamine formaldehyde (MF) polymer in this example is a condensation product of melamine and formaldehyde. The general (simplified) structure is shown below.

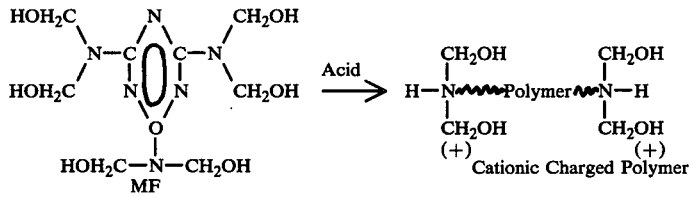

The printed fabric was dried at 300° F. and cured between 290°-310° F. The cured fabric was split into four separate pieces and acid dyed using an aqueous dye bath. The dye bath with the cured fabric samples contained therein were maintained at the boil for 30 minutes to give blue, yellow, gray and green on white shades using the following acid dye baths. In each bath the ingredients are reported as percent based on the weight of the fabric being dyed.

| Dye Formulation Ingredients | Blue | Yellow | Gray | Green |
|---|---|---|---|---|
| 84% Acetic Acid | 1.0 | 1.0 | 1.0 | 1.0 |
| Ammonium Phosphate | 1.5 | 1.5 | 1.5 | 1.5 |
| Intralan Brilliant Yellow 3GL (powder) | 0.0018 | 0.024 | 0.0086 | 0.0187 |
| Iragonal Red BL (powder) | 0.00052 | 0.0018 | 0.0032 | 0.0012 |
| Telon Fast Blue ARW (powder) | 0.0220 | 0.0013 | 0.0086 | 0.0077 |

EXAMPLE II

A 100% polyester double knit fabric made from T56 dispersed dyeable yarn was printed and dyed in a similar manner to Example I to give a properly colored pattern on a white background.

EXAMPLE III

A 100% polyester woven fabric made from T56 disperse dyeable yarn was printed and dyed in a similar manner to Example I.

EXAMPLE IV

A 100% polyester woven and knit fabric made from T235 cationic dyeable yarn was printed and dyed in a similar manner to Example I.

EXAMPLE V

A 65/35 polyester/cotton woven fabric was printed and dyed in a similar manner to Example I.

EXAMPLE VI

An acrylic upholstery fabric made from T16 cationic dyeable yarn was printed and dyed in a similar manner to Example I.

EXAMPLE VII

The polyester Raschel fabric from Example I was printed in a similar manner to Example I; but, dyed in an aqueous bath containing the proper colors. The dye bath was maintained, during the drying cycle at the boil and the fabric was maintained in contact with the dye bath for 30 minutes. Dark brown acid and light brown dispersed dyes were present in the same bath. The pattern e.g., polymer printed portion, dyed darker than the background shade to give a tone-on-tone effect. Likewise, a different colored pattern than the background was produced by dyeing with blue acid dyes and red dispersed dyes in the same bath. The general dye formulation is shown below:

| | Percent based on weight of fabric being dyed |
|---|---|
| 84% Acetic Acid | 1.00% |
| Sequesterant ST | 0.25 |
| Acid Dyed: | 0.00048 |
| Intralan Brilliant Yellow 3 GL (powder) | |
| Irganol Red BL | 0.0027 |
| Telon Fast Blue ARW | 0.0027 |
| Disperse Dyes: | 0.1664 |
| Samaron Brilliant Yellow 6 GSL | |
| Palanil Pink REL | 0.1725 |
| Samaron Blue HBL | 0.0688 |

EXAMPLE VIII

A 100% polyester double knit and woven fabric made from T56 dispersed dyeable yarn were printed in a similar manner to Example I; but, dyed in Example VII to give a tone/tone and color on color effect.

EXAMPLE IX

A 100% polyester woven fabric made with T235 light cationic dyeable heather yarn was printed in a similar manner to Example I; but, dyed in the proper colors at the boil for 30 minutes with dark brown acid and light brown basic dyes in the same bath. The pattern dyed darker than the background shade to give a tone/tone effect. Likewise, a different colored pattern then the background was produced by dyeing with blue acid dyes and red cationic dyes in the same bath. The general dye formulation is shown below:

| | | |
|---|---|---|
| Water | | |
| 84% Acetic Acid | | 1.0% o.w. goods |
| Intratex W | | 1.0 " |
| Acid Dyes: Intralan Brilliant Yellow 3GL | | 0.0169 " |
| Irganol Red BL | | 0.0072 " |
| Telon Fast Blue ARW | | 0.0058 " |
| Cationic Dyes: Sevron Yellow 8GMF | | 0.6336 " |
| Basacryl Red GL | | 0.308 " |
| Genacryl Blue 3G | | 0.0608 " |

EXAMPLE X

Two polyester double knit fabrics, one made with T232 cationic dark dyeing heather yarn and T92 100% cationic dyeable yarn were printed in a similar manner to Example I; but, dyed as in Example IX. The T232 fabric producing a tone/tone with a heather background and the T92 producing at tone/tone solid dyed background.

EXAMPLE XI

An acrylic upholstery fabric (rayon backed) made with T16 cationic dyeable yarn was printed in similar manner to Example I; but, continuous range dyed (pad, steam) with a combination of acid and cationic dyes in the same pad bath. It should be noted that direct dyes can be added to dye the rayon backing. The pattern dyed dark and the background lighter. The general dye formulation is shown below:

| | | g/lit (Pad bath) |
|---|---|---|
| Water | | |
| Syngum D470 thk | | 2.0 |
| Hostadal CVA | | 1.0 |
| Synfoam K | | 2.5 |
| Dowanol EPH | | 10.0 |
| MSP | | 10.0 |
| Acetic Acid | | 1.0 |
| Basic Dye: | Astrazon Gold Yellow GL | 0.52 |
| | Astrazon Red F 3 BL | 0.018 |
| | Astrazon Blue 5RL | 0.176 |
| Acid Dye: | Nylton Fast Yell. RLL | 0.260 |
| | Nylton Fast Blue FLN | 0.088 |
| | Merpacyl Red G | 0.018 |
| Direct Dye: | Amafast Yell. RLD | 0.360 |
| | Amafast Red 8 BLS | 0.120 |
| | SS Grey CGLL Conc. | 0.180 |

Pad, steam 10 minutes.

EXAMPLE XII

The polyester Raschel fabric from Example I was printed and dyed in a similar manner as Example I but the acid dyeable polymer is a polyurethan and was formulated for printing as follows:

| | |
|---|---|
| Water | |
| X-1042 (Polyurethane) (50%) | 30.0 |
| Ethylene Glycol (Hygroscopic Agent) | 2.3 |
| Antifoam | 0.2 |
| Fugitive Tint | 1.8 |
| Lutexol SF (Thickener) 4.6 | |
| | 100.0 |

Brookfield Viscosity (#4/12) 40,000 CPS

The polyurethane in this example is a fully reacted thermoplast formed by dispersing NCO terminated prepolymers of a polyether and toluene diisocyanate in water then chain extending with a diamine. The general structure of a polyurethane is shown below:

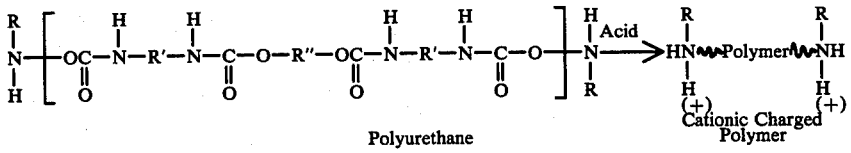

EXAMPLE XIII

The polyester Raschel fabric from Example I was printed and dyed in a similar manner as Example I but the acid dyeable polymer is an acrylic polymer and was formulated for printing as follows:

| Ingredients | % |
|---|---|
| Water | 28.7 |
| Rhoplex E 1179 - Cationic Acrylic (60%) Polymer | 66.0 |
| Antifoaming Agent | 0.2 |
| Fugitive Tint | 2.0 |
| Catalyst - $NaHCO_3$ | 2.0 |
| Thickener - Cellosize QP 4400H | 1.1 |
| | 100.0 |

Brookfield Viscosity (#4/12) 23,000 CPS

A similar acrylic polymer may be represented by the general structural formula

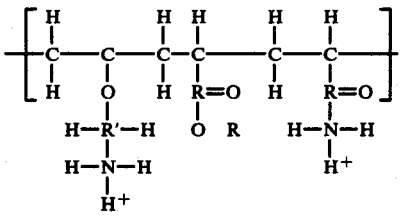

wherein R and R′ are as hereinbefore defined. The polymer printed fabric after dyeing and curing was dyed to provide a fabric having a property colored fabric on a white background.

The above examples clearly demonstrate the improved fabrics and method for producing some of the present invention. Numerous modifications and variations may be possible by those skilled in the art from a reading of the disclosure without departing from the scope of the invention as set forth in the appended claims.

Having thus described the invention, I claim:

1. A method for imparting a dyeable pattern to a synthetic textile fabric substrate formed of synthetic fibers selected from the group consisting of polyester, acrylic, nylon, and blends thereof which comprises:

applying to said substrate, in a predetermined pattern, an aqueous admixture consisting essentially of from about 1 to about 45 percent of a substantially water-soluble acid dyeable polymer having a cationic charge in milliequivalents/gram of polymer of from about 0.01 to about 5, said aqueous admixture having a viscosity of from about 5 to about 50,000 centipoise; drying the resulting polymer printed substrate at a temperature effective to remove substantially all of the water therefrom; curing the substantially dried polymer printed substrate, and, dyeing the cured polymer printed substrate with a dye admixture containing an acid dyestuff preferential to the polymer coated portion of the substrate.

2. The method of claim 1 wherein said acid dyeable polymer is selected from the group consisting of polyurethane, polyacrylate, polyvinyl pyridine, thermosetting polymers (aminoplasts) and polymers formed as the reaction product of a polyamide and an epoxy compound having at least two 1,2-epoxy groups per molecule.

3. The method according to claim 2 wherein said curing is carried out at a temperature of from about 275° F. to about 300° F. for a period of time effective to insure crosslinking of the polymer.

4. The method according to claim 3 wherein said aqueous admixture includes from about 0.5 to about 3 weight percent of a thickening agent.

5. The method of claim 3 wherein said thickening agent is present in an amount of from about 1 to about 2 weight percent and said aqueous admixture has a viscosity of from about 20 to about 40,000 centipoise.

6. The method of claim 5 wherein said aqueous admixture includes from about 3 to about 5 weight percent of a hygroscopic agent.

7. The method of claim 6 wherein said aqueous admixture includes from about 0.1 to about 0.3 weight percent of an antifoaming agent.

8. The method according to claim 7 wherein said aqueous admixture includes from about 0.1 to about 2 weight percent of an inert water fugitive tint composition.

9. The method according to claim 1 wherein the dyestuff present in said dye containing admixture is an anionic dyestuff.

10. The method according to claim 9 wherein said dye containing admixture further contains a dyestuff preferential to the untreated portion of the textile substrate.

11. The method according to claim 10 wherein said dye containing solution is maintained at a temperature of from about 190° F. to about 212° F. and at atmospheric pressure during dyeing of said coated polymer textile material.

12. The method according to claim 2 wherein said substantially water-soluble polymer is a thermosetting melamine-formaldehyde polymer and said aqueous admixture further includes from about 0.5 to 10.0 weight percent of an abrasive resistant agent from about 0.1 to about 2 weight percent of a stabalizing agent, and a catalytic amount of a latent acid catalyst.

13. The method according to claim 12 wherein said abrasive resistant agent is present in an amount of from about 1.5 to 3.5 and is selected from the group consisting of acrylic polymers, ethylene vinyl acetate polymers, alkyd polymers, vinylidine chloride, polybutadiene and urethane.

14. The method according to claim 13 wherein said aqueous admixture includes from about 0.1 to about 0.3 weight percent of an antifoaming agent and from about 0.1 to about 1 weight percent of an inert water fugitive tint composition.

15. The method according to claim 14 wherein the dyestuff present in said dye containing admixture is an anionic dyestuff.

16. The method according to claim 15 wherein said dye containing admixture further contains a dyestuff preferential to the untreated portion of the textile substrate.

17. A textile fabric substrate having cross-linked thereto, in a predetermined pattern, an effective amount of a cured acid dyeable polymer having a cationic charge in milliequivalents/gram of polymer of from about 0.01 to about 5.

18. The textile fabric substrate of claim 17 wherein said acid dyeable polymer is selected from the group consisting of polyurethane, polyacrylate, polyvinyl pyridine, thermosetting polymers (aminoplasts) and polymers formed as the reaction product of a polyamide and an epoxy compound having at least two 1,2-epoxy groups per molecule.

* * * * *

UNITED STATES PATENT OFFICE

CERTIFICATE OF CORRECTION

Patent No. 4,131,422 Dated December 26, 1978

Inventor(s) Manuel A. Thomas et al.

It is certified that error appears in the above-identified patent and that said Letters Patent are hereby corrected as shown below:

Column 1, line 36, before the word "using" add --produced--.

Column 4, lines 16 through 22, delete structural formula and insert therefor:

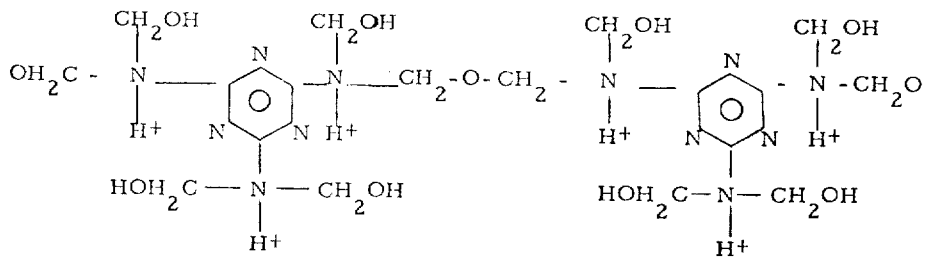

UNITED STATES PATENT OFFICE

CERTIFICATE OF CORRECTION

Patent No. 4,131,422 Dated December 26, 1978

Inventor(s) Manuel A. Thomas et al.

It is certified that error appears in the above-identified patent and that said Letters Patent are hereby corrected as shown below:

Column 8, line 8, insert --Brookfield Viscosity (#4/12 rpm.) - 31,500 cps--.

Column 9, line 21, change "Dyed" to --Dyes--.

Signed and Sealed this

*Thirtieth* Day of *December 1980*

[SEAL]

*Attest:*

SIDNEY A. DIAMOND

*Attesting Officer*

*Commissioner of Patents and Trademarks*